United States Patent [19]

Silver

[11] Patent Number: 4,522,306

[45] Date of Patent: Jun. 11, 1985

[54] RACK MODULE

[75] Inventor: William Silver, New York, N.Y.

[73] Assignee: Thomson-Leeds Company, Inc., New York, N.Y.

[21] Appl. No.: 471,231

[22] Filed: Mar. 2, 1983

[51] Int. Cl.[3] ..... A47F 7/00

[52] U.S. Cl. ..... 211/49.1; 211/59.1

[58] Field of Search ..... 211/49 D, 90, 187, 153; 248/205.3, 1; 206/509, 44.12; 220/23.6, 23.83; 312/111, 42

[56] References Cited

U.S. PATENT DOCUMENTS

| | | | |
|---|---|---|---|
| D. 187,668 | 4/1960 | Bauer | D6/85.1 |
| 2,295,313 | 9/1942 | Weir | 211/59.2 |
| 3,552,817 | 1/1971 | Marcolongo | 312/111 X |
| 4,146,278 | 3/1979 | Seitel | 312/42 X |
| 4,294,365 | 10/1981 | Henderson | 248/205.3 X |

*Primary Examiner*—Ramon S. Britts
*Assistant Examiner*—Sarah A. Lechok
*Attorney, Agent, or Firm*—Howard C. Miskin

[57] ABSTRACT

A rack module for storing a stack of cigarette packs for individual manual dispensing includes a box shaped open front body member having complementary dove tail couplings formed on its top and bottom faces and pivot pins on its upper forward side borders. A visor member includes a face wall and upwardly rearwardly extending side hinge plates having on its upper borders transversely spaced pairs of laterally aligned hinge bores selectively engaging the pivot pins. Bosses on the body member side wall engage recesses in the hinge plates to releasably lock the visor member in its vertical closed position in transverse registry with the body member opening. A resiliently compressible pad with a pressure sensitive adhesive outer face is positioned on a body member vertical face.

11 Claims, 8 Drawing Figures

FIG. 5
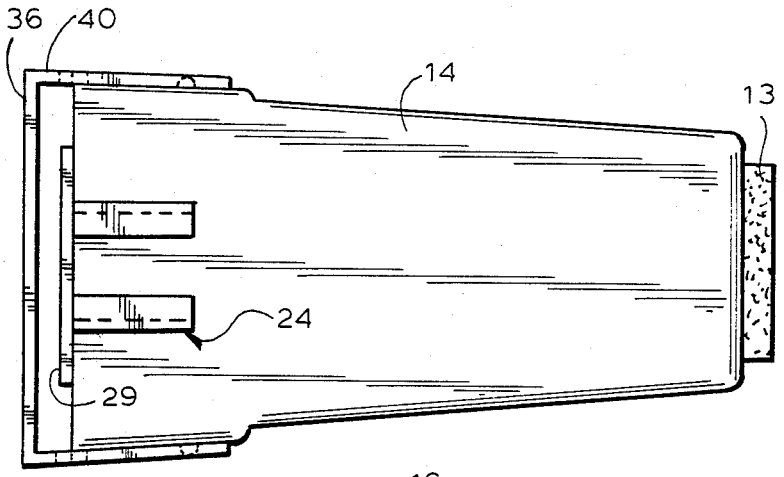
FIG. 7
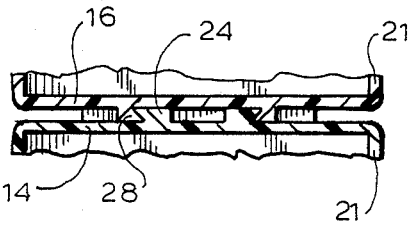
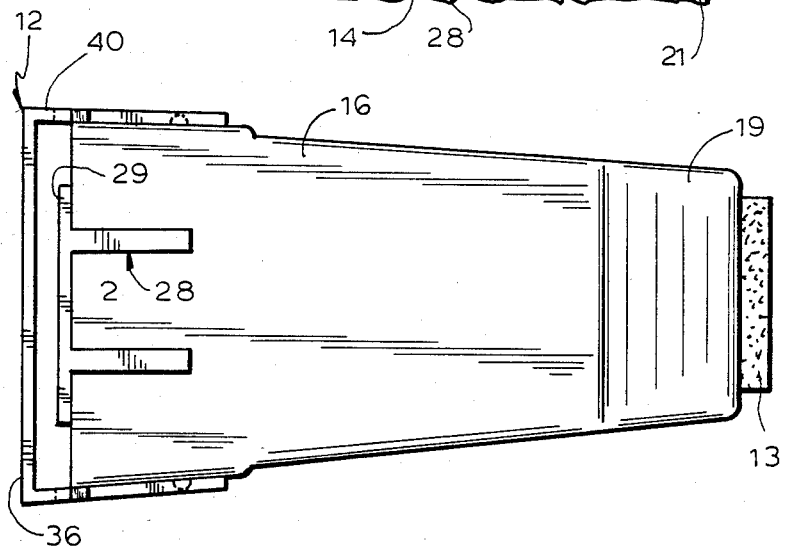
FIG. 6

RACK MODULE

BACKGROUND OF THE INVENTION the present invention relates generally to improvements in storing and dispensing devices and it relates more particularly to an improved rack module for storing a stack of cigarette packs for the manual dispensing of individual packs and which may be attached to available surfaces or supports.

In the manual dispensing of individual packs of cigarettes from stores of different brands of cigarettes it is a common practice to vertically stack the cigarette packs in separate groups of different brands so a pack of a selected brand is readily available. In permanent installations racks divided into vertical columns which are in turn horizontally subdivided, each of the subdivisions being available for holding a stack of cigarette packs of a desired brand so that a pack of a selected brand may be withdrawn from the top of the respective pack. This structure as well as other available and proposed cigarette dispensing arrangements, however, possess numerous drawbacks and disadvantages. They are awkward structures which in many areas are of limited available capacity and difficult to erect and install. Where space is restricted, moreover, access to the rack for loading or dispensing, is often inconvenient and awkward and such devices are of little versatility and adaptability and otherwise leave much to be desired.

SUMMARY OF THE INVENTION

It is a principal object of the present invention to provide and improved storage and dispensing device.

Another object of the present invention is to provide an improved rack module.

Still another object of the present invention is to provide an improved article storing and dispensing rack module.

A further object of the present invention is to provide an improved cigarette pack storing and dispensing rack module which may be assembled, coupled and supported in many desired positions, arrangments and relationships and may be employed to supplement existing racks.

Still a further object of the present invention is to provide an improved module of the above nature characterized by its simplicity, low cost, high reliability, attractive appearance, ease and convenience of assembly, erection and use and great versatility and adaptability.

The above and other objects of the present invention will become apparent from a reading of the following description taken in conjunction with the accompanying drawings which illustrate a preferred embodiment thereof.

A rack module in accordance with the present invention includes an open front hollow rectangular body member having horizontal parallel top and bottom walls, parallel vertical side walls and a vertical rear wall, complementary top and bottom coupling members similarly located on the top and bottom wall outside faces respectively, a visor member provided with a face panel supported by the body member for swinging about a transverse axis between an open position providing full access to the body member front opening and a closed position with the face panel registering with body member front opening while allowing access to the lower portion thereof, and a mounting device located on the body member side or rear wall for mounting the module on a support wall.

In the preferred form of the improved rack module the bottom edge of the body member rear wall is located above the level of the bottom wall and joined thereto by a forwardly downwardly inclined panel and the side walls are relatively narrow panels joining the front side edges of the top and bottom walls. The top and bottom coupling members include complementary dove tail groove and ridge and the visor member includes a pair of transversely spaced side panels extending rearwardly and upwardly from the upper corners of the face panel. Formed in each of the side panels are upper and lower pairs of transversely spaced apertures, the body member side walls having coaxial outwardly directed pivot pins at their upper front corners which engage a selected pair of coaxial upper apertures to permit the swinging of the visor between open and closed positions and a boss is formed on each body member side wall to releasably engage a respective side panel lower aperture in the visor closed position. The mounting device is a resilient compressible pad having a pressure adhesive outer face.

The improved rack module is of rugged, inexpensive and simple construction is easily coupled to other like modules in vertical or side by side positions to produce any desired arrangenent, is readily and easily mounted to any support surface, is convenient to load a stack of articles and withdraw individual articles and is of great versatility and adaptability.

BRIEF DESCRIPTION OF THE DRAWINGS

FIG. 5 is a top plan view;

FIG. 6 is a bottom plan view; and

FIG. 7 is a fragmented lateral sectional view showing the intercoupling of a pair of vertically spaced modules.

DESCRIPTION OF THE PREFERRED EMBODIMENT

Figure 1:
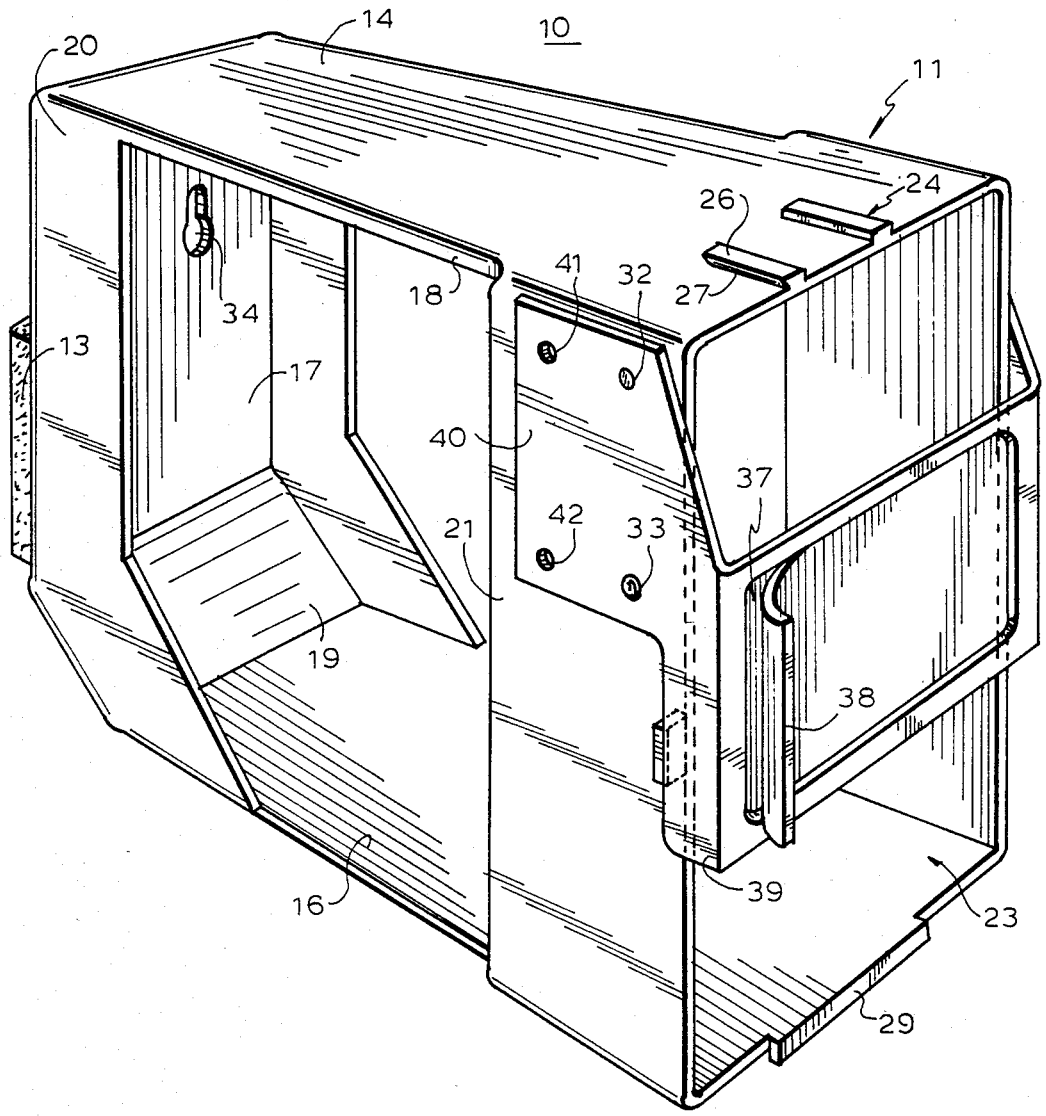
FIG. 1 is a front perspective view of a rack module embodying the present invention for the storing and dispensing of cigarette packs and shown in a visor closed condition.
Figure 2A:
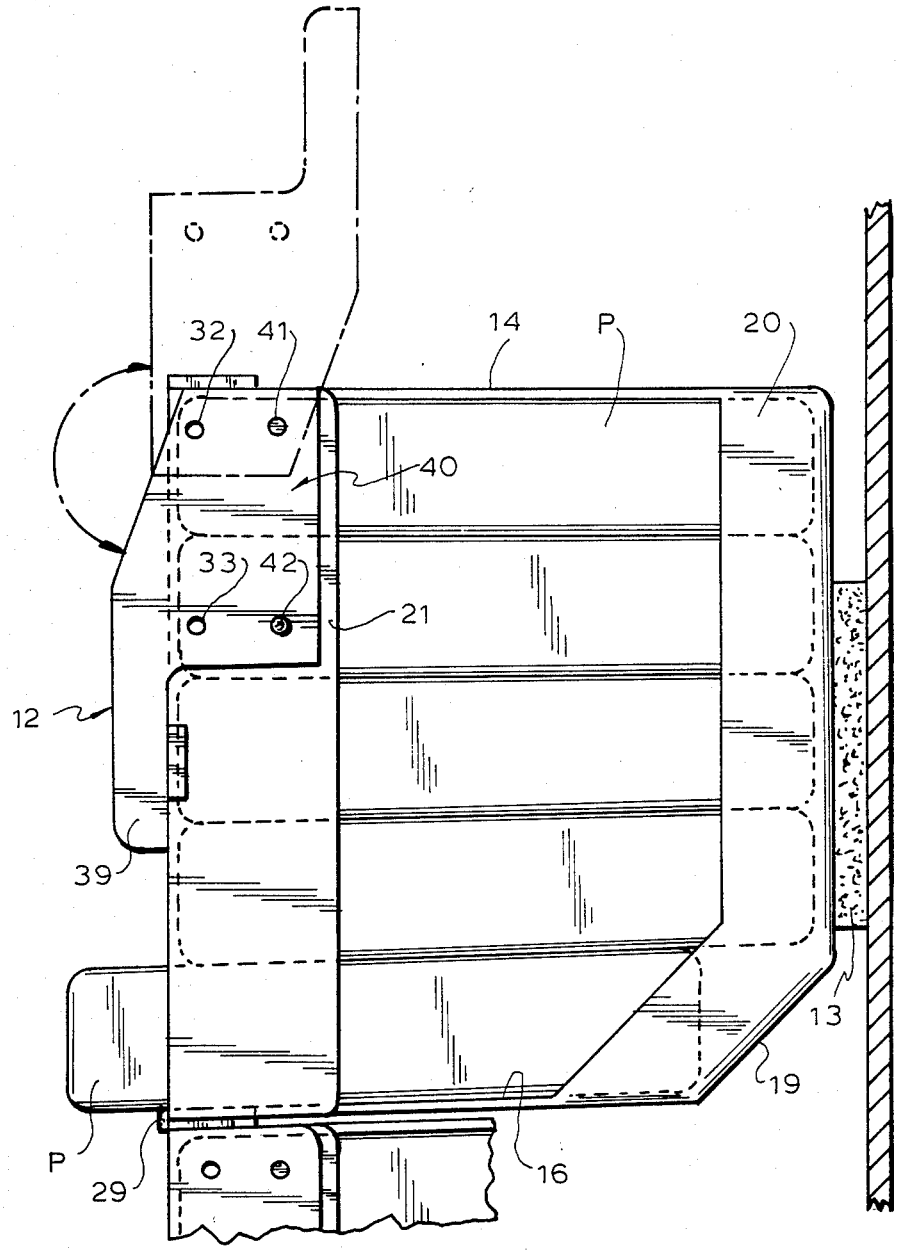
FIG. 2A is a side elevational view thereof, shown coupled to a lower module, mounted to a rear support wall the visor being illustrated in a king size cigarette pack accomodating position and by broken line in an open position.
Figure 2B:
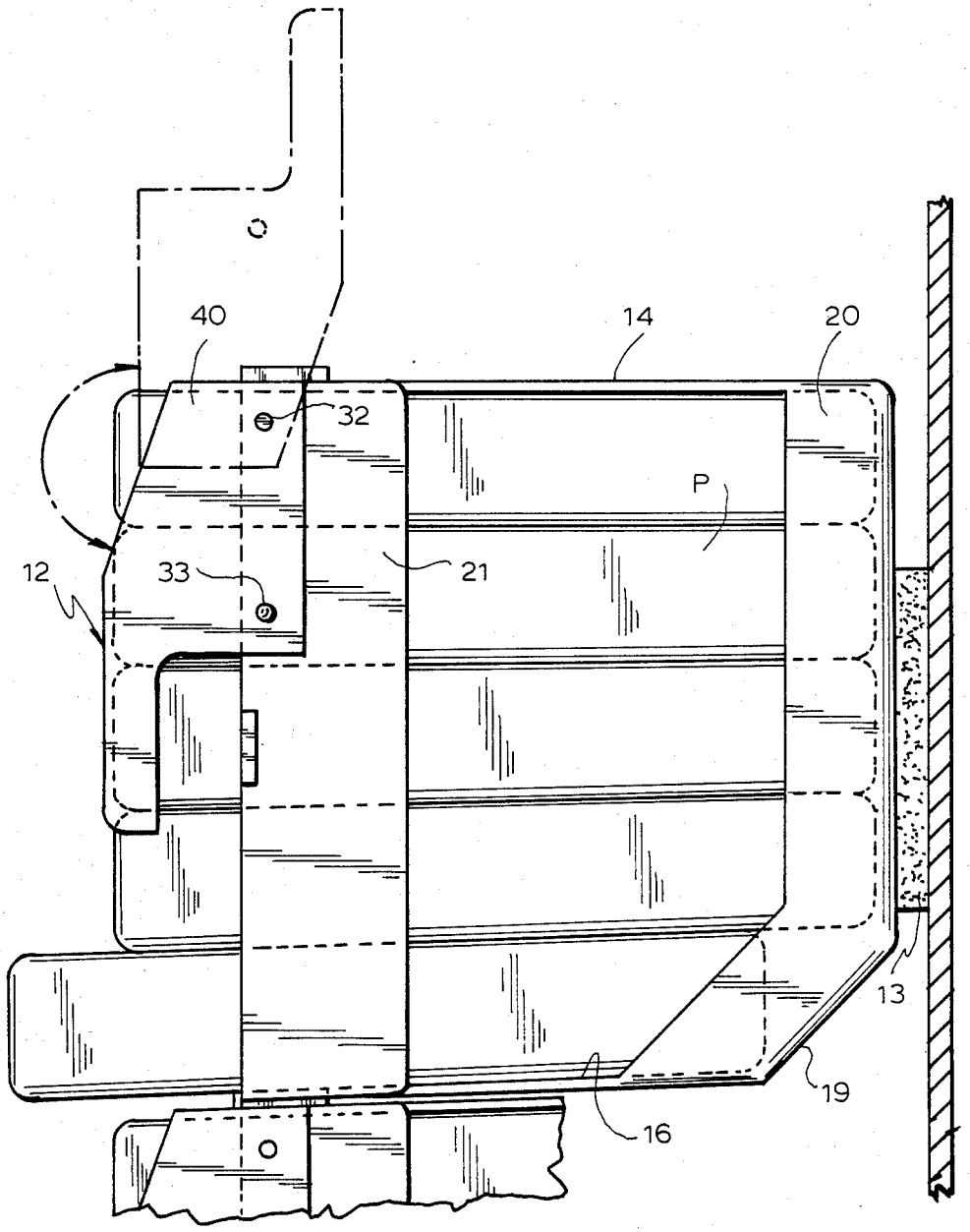
FIG. 2B is a view similar to FIG. 2A but with the visor being in a forward adjusted position to accomodate 100's size cigarette packs.
Figure 3:
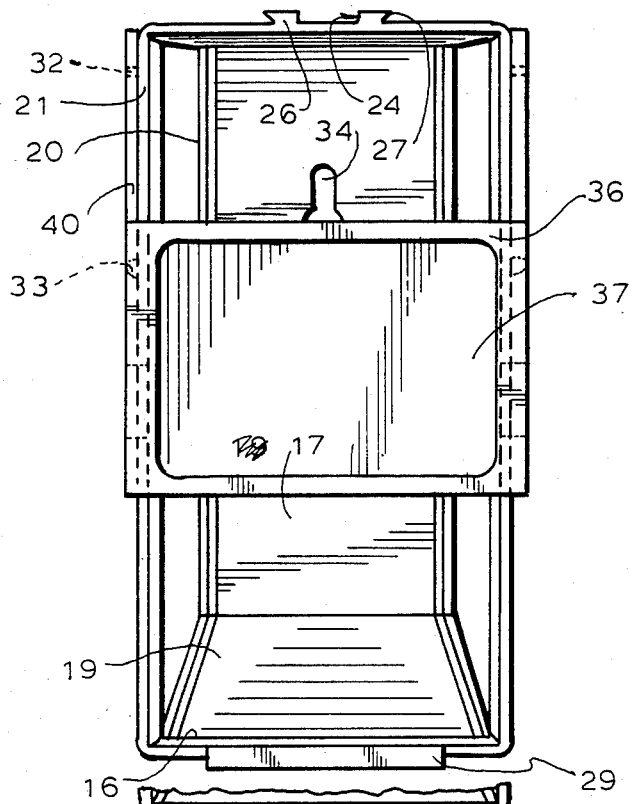
FIG 3 is a front elevational view thereof shown mounted to a side wall.
Figure 4:
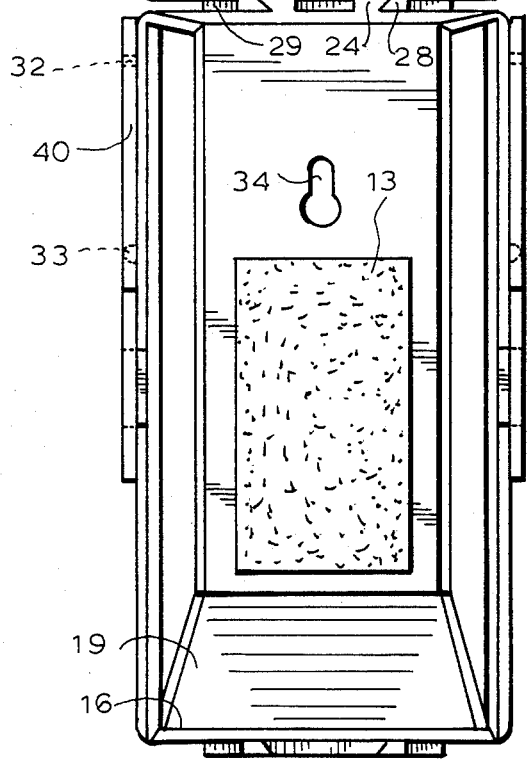
FIG. 4 is a rear elevational view thereof shown for mounting to a rear wall.

Referring now to the drawings which illustrate a preferred embodiment of the present invention as applied to the storing and dispensing of packs of cigarettes of alternative relatively short or king size or relatively long 100 size, the reference numeral 10 generally designates the improved rack module for holding a stack of five cigarette packs for the manual withdrawal of the lowermost pack. The rack module 10 includes a hollow box or rectangular parallelpiped shaped body member 11 with an open front end, a swingable front visor member 12 and a mounting or coupling device 13 for attaching the rack module 10 to a support wall.

The body member 11 is an integral unit formed, for example by injection molding of a synthetic organic polymeric resin composition and includes parallel horizontal top and bottom walls 14 and 16 respectively. Walls 14 and 16 are roughly rectangular, the side edges 18 of each wall 14 and 16 slightly rearwardly converging and the respective edges 18 of the top and bottom walls being parallel. Depending from the rear edge of top wall 14 is a vertical rear wall 17 the bottom edge of which is joined to the rear edge of bottom wall 16 by a forwardly downwardly inclined wall 19. Projecting forwardly from the side edges of rear wall 17 and inclined wall 19 and extending between between top wall 14 and bottom wall 16 are slightly forwardly diverging vertical skirt walls 20, the free edges of which are parallel to the rear wall 17 and the inclined wall 20. A pair of laterally spaced vertical parallel rectangular side walls 21 extend between vertically spaced corresponding front portions of the side edges of top and bottom walls 14 and 16, the side edge front portions of which are parallel so that short rearwardly facing lateral shoulders are formed at their rears. The front edges of top, bottom and side walls 14, 16 and 21 delineate a vertical rectangular front opening 23.

Formed on the front border of the top face of body member top wall 14 is a medially disposed dove tail male coupling member 24 including a pair of laterally spaced longitudinal parallel ridges 26 extending rearwardly from the front edge of top wall 14 and having outer inwardly downwardly inclined outer faces 27 to define a dove tail male coupling. Formed on the front border of the outer face of bottom wall 16 is medially disposed longitudinal female dove tail coupling member 28 complementing male coupling member 24 and including a pair of parallel laterally spaced ridges extending rearwardly from the front edge of bottom wall 16 and having confronting parallel upwardly outwardly inclined confronting longitudinal faces delineating a dove tail groove. Depending from the front edge of bottom wall 16 and extending the width of coupling member 28 is a flange 29 which blocks the front end of the coupling member dove tail groove.

Projecting outwardly from the opposite outer faces of side walls 21 proximate their front upper corners is a pair of laterally aligned coaxial pivot pins 32. Also projecting outwardly from the side wall outer faces vertically below pivot pins 32 are respective arcuate detents or bosses 33. A laterally medially located vertical keyhole slot 34 having an enlarged lower portion is formed in the upper part of rear wall 17.

The visor 12 includes a transversely extending rectangular face plate 36 which is vertical in the visor closed position and has a rectangular recess 37 for receiving a correspondingly shaped pressure sensitive adhesive backed label 38. Projecting rearwardly from the side edges of face plate 36 are opposite parallel flanges 39. Extending upwardly and rearwardly from the top rear corners of flanges 39 and coplanar therewith are opposite parallel hinge plates 40 embracing the upper outer faces of side walls 21. The upper and lower edges of each hinge plate 40 are, in the visor closed position, horizontal and parallel, the upper edge being slightly below top wall 14 and the lower edge being a short distance below the top edge of face plate 36, the rear edges of the hinge plates being vertical and the front edges being forwardly downwardly inclined to the top edge of face plate 36 which is disposed below the level of body member top wall 14.

A first pair of longitudinally spaced circular pivot openings 41 is formed in the upper part of each hinge plate 40 below and parallel to its top edge, openings 41 in opposite hinge plates 40 being in lateral coaxial alignment the pivot pins 32 being engagable by selective pairs of coaxial opendings 32. A second pair of longitudinally spaced circular openings 42 is formed in each hinge plate 40 below openings 41 in vertical alignment with corresponding opening 41, one of the openings 42 of each pair releasably engaging a corresponding boss 33 in the visor closed position.

Each of the rectilinear walls of body member 11, particularly the side and rear walls, is provided with positioning marks to accurately optimumly locate on the outer face of one or more of the walls a mounting pad 13. The mounting pad 13 is of rectangular configuration and is formed of a resilient compressible sponge material secured to a respective body member face by a pressure sensitive adhesive carrying face of the pad, the outer face of the pad also carrying a layer of a pressure sensitive adhesive for attachment to the face of a support wall or panel.

Each of the rack modules 10 is adjustably assembled for accomodating packs of long or short cigarettes by sliding the visor member 12 to bring either the rear pair of coaxial openings 41 or the front pair of coaxial openings 41 into pivotal engagement with pivot pins 32. Two or more rack modules 10 may be assembled into vertical stacked arrangment by slidably intercoupling complementary male and female coupling members 24 and 28 on the confronting faces of contiguous modules. Individual rack modules 10 or assembled groups of modules may be mounted on rear or side walls or located on a horizontal walls by means of one or more mounting pads 13 adherent to the rear side or bottom walls of the modules and press adhered to the corresponding support wall. Modules 10 may be assembled side-by-side by means of pads 13 between confronting side walls of adjacent modules. A module may be attached to a rear support wall by means of keyhole slot 34 and a headed projection on the support wall. Moreover, the modules 10 may be inserted in respective correspondingly dimensioned compartments of a vertical rack.

In loading a rack module 10 the visor 12 is swung to an open position fully exposing front opening 23 and a stack of five cigarette packs P is inserted through opening 23 into the module and rests on bottom wall 16 with the bottom pack P being forwardly projected for easy withdrawal by inclined wall 19. The visor is swung to a closed position to bring a pair of openings 42 in engagement with bosses 33 to releasably lock the visor in closed position, in which position the bottom edge of face plate 36 registers with the front face of the next lowermost pack P to prevent its withdrawal with the withdrawal of the bottom pack. Upon the withdrawal of the bottom pack the overlying stack drops onto bottom wall 16, inclined rear wall 17 urging the bottom pack forward.

While there has been described and illustrated a preferred embodiment of the present invention it is apparent that numerous alterations, additions and omissions may be made without departing from the spirit thereof.

I claim:

1. A rack module comprising a body member including vertically spaced parallel horizontal top and bottom walls, a vertical rear wall depending from the rear edge of said top wall and vertical side panels extending between corresponding forward side edges of said top and bottom walls and having front edges delineating with the front edges of said top and bottom walls an access opening to said module extending for substantially the full height and width of said module, complementary coupling members located on the outside faces of said top and bottom walls respectively, a visor member including a face plate, means coupling said visor member to said body member for swinging about a transverse axis between an open position with said face plate located above said top wall thereby providing full front access to said body member access opening and a closed position with said face plate being in registry with said access opening and having a lower edge disposed above the level of the bottom of said access opening to delineate with said bottom wall front edge an article dispensing opening and means for mounting said module to a support member.

2. The rack module of claim 1 wherein said complementary coupling members include a dove tail grooved first coupling member formed on one of said horizontal walls and a dove tail ridged second coupling member formed on the other of said horizontal walls and slidably complementing said first coupling member.

3. The rack module of claim 1 including a forwardly downwardly inclined panel joining the bottom edge of said rear wall and the rear edge of said bottom wall.

4. The rack module of claim 1 wherein said means for swingably coupling said visor member to said body member includes means for transversely adjusting the closed position of said face plate.

5. The rack module of claim 1 wherein said module mounting means comprises a resiliently compressable pad adherent to one of said body member walls and having a pressure sensitive adhesive outer face.

6. The rack module of claim 1 wherein said visor member includes a pair of parallel vertical hinge plates projecting rearwardly from the side edges of said face plate, said hinge plates having formed in their upper portion transversely spaced pairs of laterally aligned hinge bores, said visor coupling means including a pair of outwardly projecting laterally axially aligned hinge pins formed on the upper portions of said body member side walls and pivotally engaging a preselected laterally spaced pair of said hinge bores.

7. The rack module of claim 6 comprising means for releasably locking said visor member in its closed position.

8. The rack module of claim 7 wherein said locking means comprises a boss formed on the outer face of said side wall below the level of the hinge pins and a respective visor hinge plate has a recess formed therein releasably engaging said boss when said visor is in its closed position.

9. The rack module of claim 8 including a pair of said recesses formed in and laterally spaced on said hinge plate and vertically aligned with respective hinge bores.

10. The rack module of claim 1 wherein said face plate in the open position of said visor member is directed upwardly from the level of the top of said access opening.

11. The rack module of claim 1 wherein said face plate in the closed position of said visor member is disposed forwardly of said access opening.

* * * * *